US006102297A

United States Patent [19]

Nachaj et al.

[11] Patent Number: 6,102,297

[45] Date of Patent: Aug. 15, 2000

[54] BACK-UP AUTO-THERMOSTATIC MODULATING REGULATOR

[75] Inventors: Henry Nachaj, Kirkland; Alain Hebert, Boucherville, both of Canada

[73] Assignee: Centre des technologies du gaz naturel, Québec, Canada

[21] Appl. No.: 09/124,118

[22] Filed: Jul. 29, 1998

[30] Foreign Application Priority Data

Feb. 26, 1998 [CA] Canada ..... 2230855
Mar. 26, 1998 [CA] Canada ..... 2233279

[51] Int. Cl.[7] ..... F24D 3/00

[52] U.S. Cl. ..... 237/8 R; 237/8 C; 237/19

[58] Field of Search ..... 237/8 C, 19, 8 R, 237/8 A

[56] References Cited

U.S. PATENT DOCUMENTS 5,572,985 11/1996 Benham ..... 126/362

5,588,591 12/1996 Sweitzer, Jr. ..... 237/8 C

*Primary Examiner*—Harold Joyce
*Assistant Examiner*—Derek S. Boles
*Attorney, Agent, or Firm*—Swabey Ogilvy Renault; Guy J. Houle

[57] ABSTRACT

An automatic modulating regulator device and method of operation for use with a non-electrical hot water heat source supplied by a pressurized water supply. The hot water heat source has a hot water circuit to pump hot water to heat exchange elements. The regulator device comprises a valve which when a power failure occurs changes to a normally open state. The regulator device is adapted to be connected to a hot water return conduit of the hot water circuit. A self-powered thermostatic valve is responsive to a temperature sensor and modulates the flow of hot water returned through the regulator device. A flow restrictor is connected downstream of the regulator device for releasing controlled quantities of water from the return hot water conduit to a drain.

20 Claims, 6 Drawing Sheets

BACK-UP AUTO-THERMOSTATIC MODULATING REGULATOR

TECHNICAL FIELD

The present invention relates to an automatic modulating regulator device and method of operation for use with non-electrical hot water heat sources supplied by a pressurized water supply and having a hot water circuit to pump hot water to heat exchange elements, and a method of operation.

BACKGROUND ART

During electrical power failures, all devices which are electrically operated fail and accordingly people are deprived of heat and other commodities and this can become a serious problem during long periods of power failure during major breakdowns of the electrical power distribution systems. Such a major breakdown was experienced recently in the Northeast part of the United States and the Provinces of Quebec and Ontario, Canada. Needless to say, such power failures are extremely costly and often lead to serious injury and death.

A solution to partly remedy the above-mentioned problem is to install fuel powered generators to supply electricity. However, these are costly, they occupy a large space, they are noisy and may fail if they are not constantly replenished with fuel.

SUMMARY OF THE INVENTION

It is therefore a feature of the present invention to provide an automatic modulating regulator device for use with non-electrical hot water heat sources which are supplied by a pressurized water supply, such as city water, and which have a hot water circuit to pump hot water to heat exchange elements and wherein the regulator will automatically switch to the use of the pressurized water supply as a source of convection for the hot water circuit whereby to continue to feed hot water to the heat exchange elements to provide heat.

Another feature of the present invention is to provide a method of supplying hot water to heat exchange elements connected to a hot water supply circuit of a non-electrical hot water heat source during electrical power failure and wherein the heat source is supplied by a pressurized water supply such as the city water supply.

Another feature of the present invention is to provide an automatic modulating regulator device which is connectable to the hot water return conduit of a hot water circuit of a non-electrical hot water heat source and wherein the regulator device is automatically operated and does not occupy additional floor space.

Another feature of the present invention is to provide an automatic modulating regulator device which is simple in construction and easy to install and which operates instantaneously upon detection of an electrical power failure.

According to the above features, from a broad aspect, the present invention provides an automatic modulating regulator device for use with non-electrical hot water heat source supplied by a pressurized water supply and equipped with a hot water circuit to pump hot water to heat exchange elements. The regulator device comprises valve means adapted to be connected to a hot water return conduit of the hot water circuit. The valve means has an actuator means for placing the regulator device in a normally open condition in response to an electrical power failure. A self-powered thermostatic valve is responsive to a temperature sensing means for placing the regulator device in an open condition in response to heat demand by the temperature sensing means. A flow restrictor means releases controlled quantities of water from the return hot water conduit of the hot water circuit through the regulator device when both the valve means and the thermostatic valve place the regulator device in an open condition.

According to a still further broad aspect of the present invention, there is provided a method of supplying hot water to heat exchange elements connected to a hot water supply circuit of a non-electrical hot water heat source during electrical power failure. The heat source is supplied by a pressurized water supply. The method comprises the steps of providing an automatic regulator device and a hot water return conduit of the hot water supply circuit. The device has a flow-through conduit. An electrically operative normally-open valve is associated with the flow-through conduit and is normally open in the absence of electrical power. A self-powered thermostatic valve is also associated with the flow-through conduit and responsive to temperature change. A flow restrictor is connected to an output of a thermostatic valve and to a drain. The method also provides the step of connecting a temperature sensor associated with a thermostatic valve to sense the ambient temperature of an area being heated by at least one of the heat exchange elements. The flow rate of the thermostatic valve is set not to exceed the recovery rate of the water heat source. The electrically operated valve is automatically placed in a normally open condition upon the loss of electrical power to release hot water from the hot water return conduit into the drain whereby the hot water supply circuit is fed hot water under pressure by the pressurized water supply feeding the heat source in a controlled modulated manner.

BRIEF DESCRIPTION OF THE DRAWINGS

The preferred embodiments of the present invention will now be described with reference to the accompanying drawings in which.

DESCRIPTION OF PREFERRED EMBODIMENTS

Figure 1:
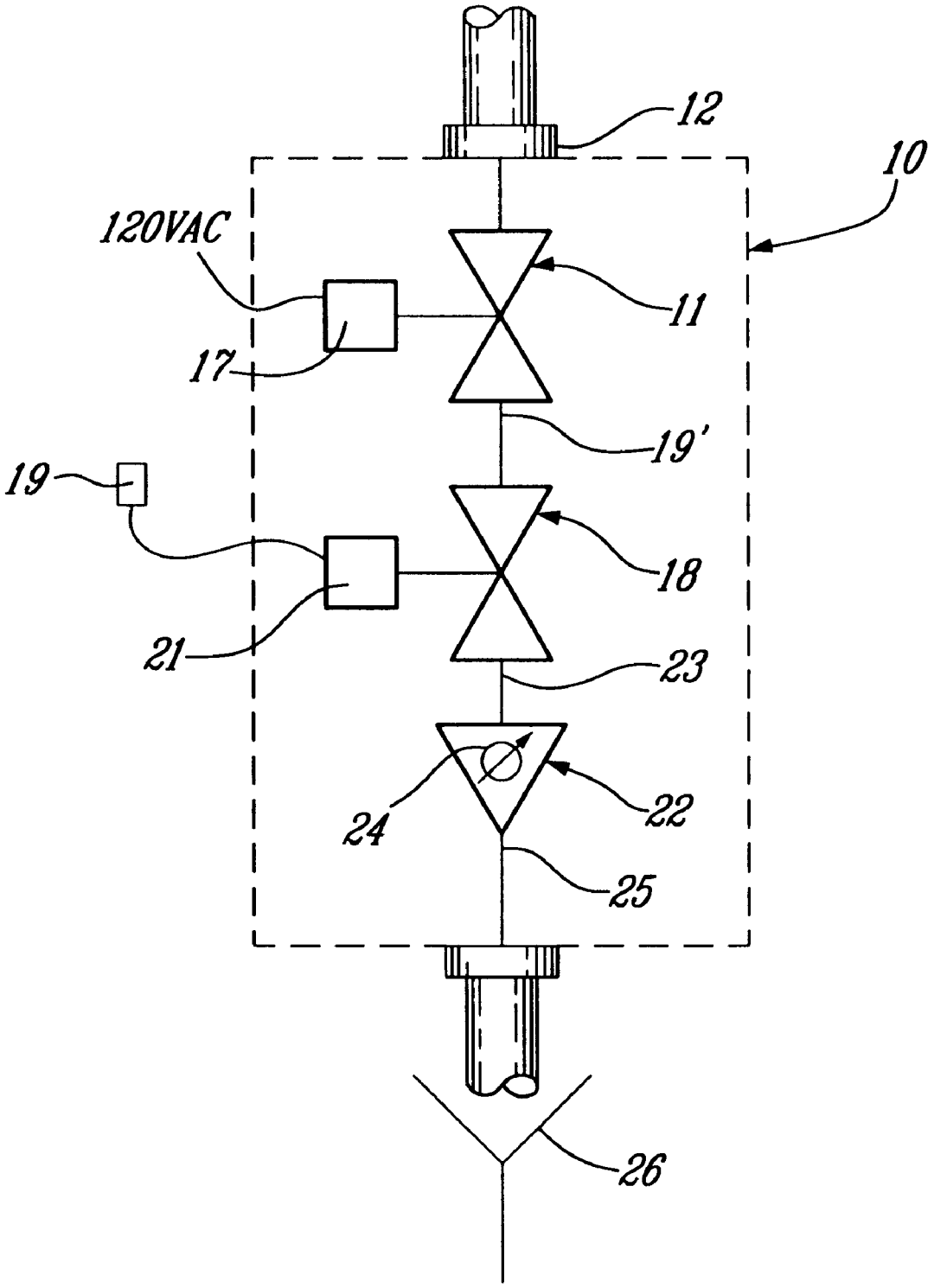
FIG. 1 is a schematic diagram illustrating the construction of the automatic modulating regulator device.
Figure 3:
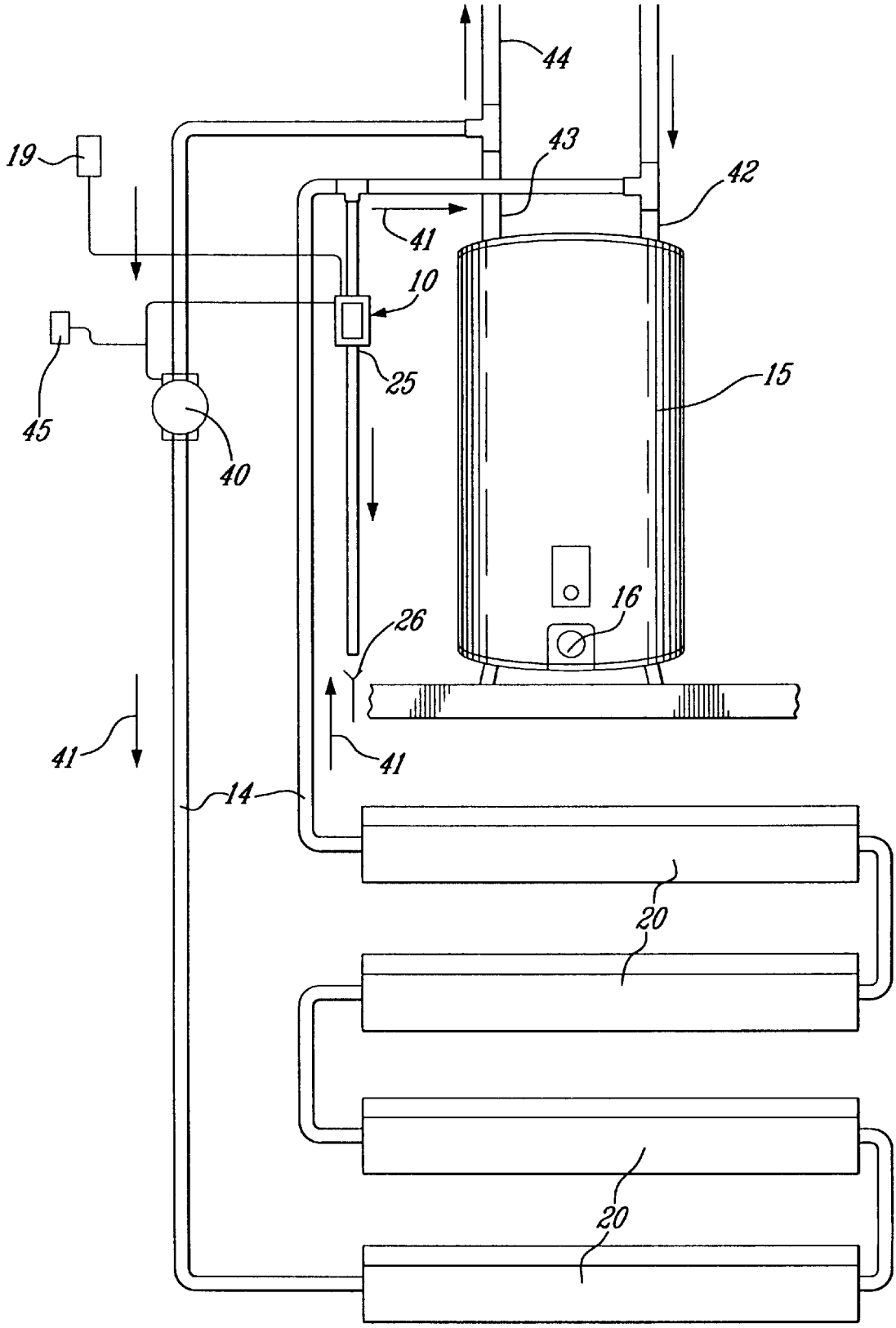
FIG. 3 is a schematic diagram showing a non-electrical hot water heater or furnace which is supplied pressurized city water and which is used to feed heat exchange elements to heat a building and wherein the automatic modulating regulator device has been integrated therewith.

Referring now to the drawings and more particularly to FIG. 1, there is schematically illustrated the construction of the automatic modulating regulator device 10 of the present invention. The device 10 comprises a normally-open electrically operated valve 11 having a coupling 12 at its input whereby to connect same to a hot water return conduit 13, as shown in FIG. 3, of a hot water circuit 14 connected to a water heat source 15 which is powered by a gas-fired burner 16 or an oil-fired burner or other non-electrical source such as solar panels.

The normally open electrically operable valve 11 has an electrical actuator 17 which, when switched "on", places the normally open valve 11 in a closed condition. The actuator is an electrically-operated solenoid or a motorized valve. Upon a loss of electrical power, this actuator 17 automatically switches on to place the valve 11 to its normally open condition. A self-powered thermostatic valve 18 is connected to the outlet 19' of the normally open electrically operable electrical valve 11 and is provided with a temperature sensor 19 which is normally installed in a room which is heated by at least one of several heat exchange elements 20 (see FIG. 3) of the hot water circuit 14 whereby to monitor the temperature of that room and through a self-powered actuator 21 places the thermostatic valve 18 in an open or closed condition.

The automatic modulating regulator device 10 also includes a flow restrictor 22 which is connected in a flow-through conduit 38 of the regulator (see FIG. 2A) at the outlet 23 of the self-powered thermostatic valve 18 and this flow restrictor is a normally-open valve 29 (see FIG. 2A) which is provided with a settable control 24 to control the flow rate of the valve not to exceed the recovery rate of the heat source associated therewith. The control 24 is set depending on the maximum recovery rate of the heating unit. For example, with a water heater having a 60 gallon/hour recovery rate, the maximum setting would be at 1 gallon/minute maximum flow rate. With a hot water furnace having a recovery rate of 120 gallons/hour, the maximum setting would be 2 gallons/minute maximum flow. The outlet 25 of the flow restrictor 22 is connected to a drain 26 such as a city drain which is provided in the building where the hot water heater is installed.

Figure 2A:
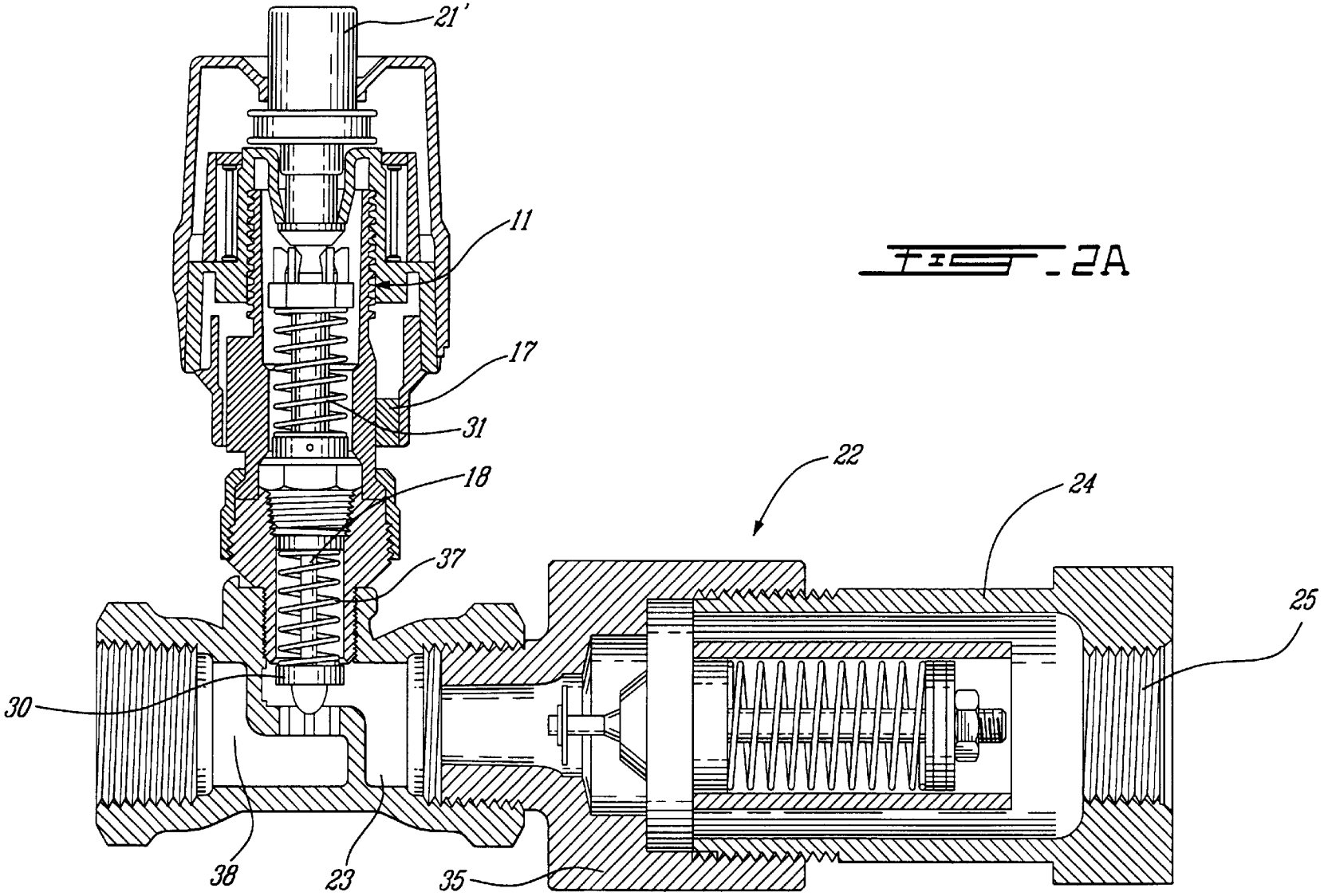
FIG. 2A is a fragmented section view of the actual integrated automatic modulating regulator device of the present invention.

Referring now to FIG. 2A, there is illustrated an actual implementation of the automatic modulating regulator device 10 of the present invention. As herein shown, the normally-open electrically-operated valve 11 is concentrically mounted with the self-powered thermostatic valve 18. The flow restrictor 22 is threadably connected to the outlet coupling 23 of the concentric valve structure. This two component modular design is integrated in a nickel-plated bronze valve body 27. The electrically-operated valve 11 is closed upon being supplied electrical power to the electric coil 28 thereby drawing the valve disc 30 to a closed position as shown in FIG. 2A. This electrically-operated valve 11 is designed to quietly control flow from the hot water circuit 14 during power outages, through slow opening and closing cycles to reduce noise and eliminate the damaging effect of water hammer.

Figure 2B:
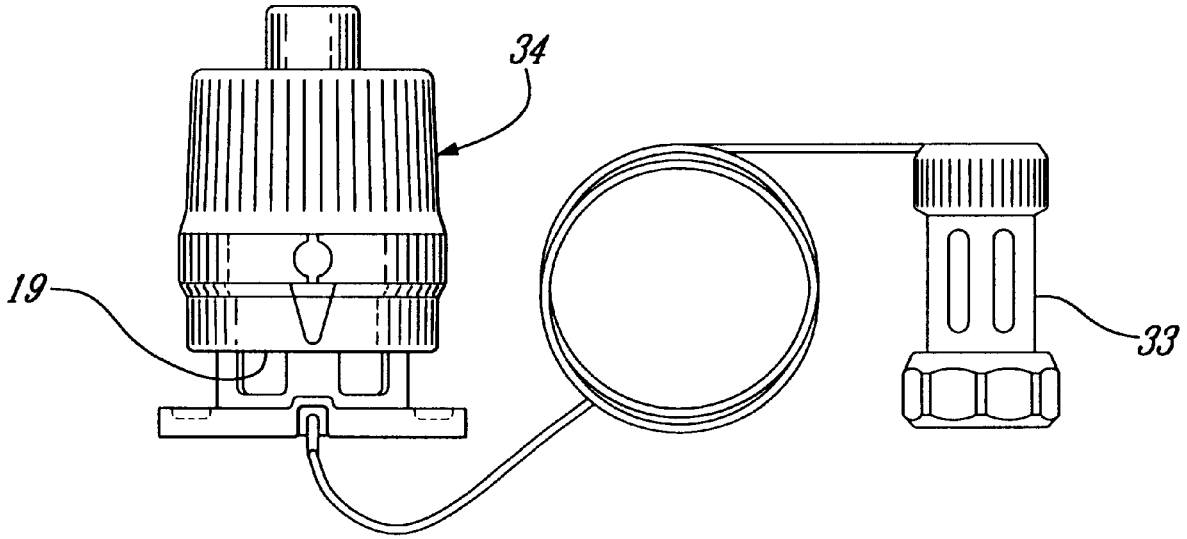
FIG. 2B is a side view of the thermostat and coupling associated with the self-powered thermostatic valve.

The self-powered thermostatic valve 18 is provided with a bellows operated valve actuator 21' which also controls the valve disc 30 through a spring loaded push rod 31. As herein shown two push rods 31 and 32 are also concentrically mounted and individually spring actuated by the normally-open electrically-operated valve 11 and the self-powered thermostatic valve 18, respectively. On top of the bellows valve actuator 21' is mounted a connector 33 (see FIG. 2B) associated with the temperature sensor 19 which is located in the adjustable thermostat 34 shown in FIG. 2B. The rate of closing and opening of the disc 30 is directly in relation with ambient temperature sensed by the sensor 19 of the thermostat 34 and the required temperature setting of this thermostat. The self-powered thermostatic valve 18 thus modulates the water flow according to the ambient temperature requirements. The automatic flow control is adjustable for the different recovery rates of the heat source by the flow restrictor 22 which is also mounted in a housing 35 threadably connected to the housing 30. The outlet 25 of the restrictor connects to a drain pipe and drain as is obvious to persons skilled in the art. The spring within the unit is self regulating for changes in water pressure. On a less expensive version, an orifice disc can be used to restrict the maximum water flow rate.

The automatic modulating regulator device 10 is normally connected to the return line of the feeding circuit 14 just before the connection to the heat source. A T-type branch connection is sufficient for its coupling. A pipe of sufficient capacity is then connected to the device.

When under electrical power, the electrically activated actuator 18 forces the valve disc 30 to close. This prevents any flow through the device 10. During a power failure, the electrically activated actuator loses power and opens the valve disc 30. The remote adjustable thermostat 34 is adjusted manually to the desired comfort setting. The remote ambient element senses ambient temperature and controls the valve through the bellows actuator 21'. The larger the difference in thermostat setting, the larger the flow rate. In the spring loaded flow control, an adjustment to the spring and proper sizing of the control valve disc is required. On the orifice type of flow control, an opening of the proper diameter for the given system pressure is required.

Referring now to FIG. 3, there is shown a baseboard heating system which is fed hot water from a gas-fired hot water reservoir or furnace 15 through the hot water circuit 14. The heat exchangers or baseboard heaters 20 are connected in series in the hot water circuit and a pump 40 circulates the water through the hot water circuit 14 in the direction of arrows 41. The hot water source is fed city water under pressure through the feed pipe 42 and the hot water from the tank will exit through the feed pipe 43 whereby to feed the hot water circuit 14. The feed pipe 43 is also provided with a circuit 44 to provide hot water for domestic use. A thermostat 45 is connected to the pump 40 and to the automatic modulating regulator device 10 to circulate hot water through the hot water circuit when the temperature sensed by the thermostat falls below a desired setting. Of course, there may be more than one thermostat 45 connected to the pump and to the automatic modulating regulator device depending on the extent of the hot water circuit and its heat exchangers.

Figure 4:
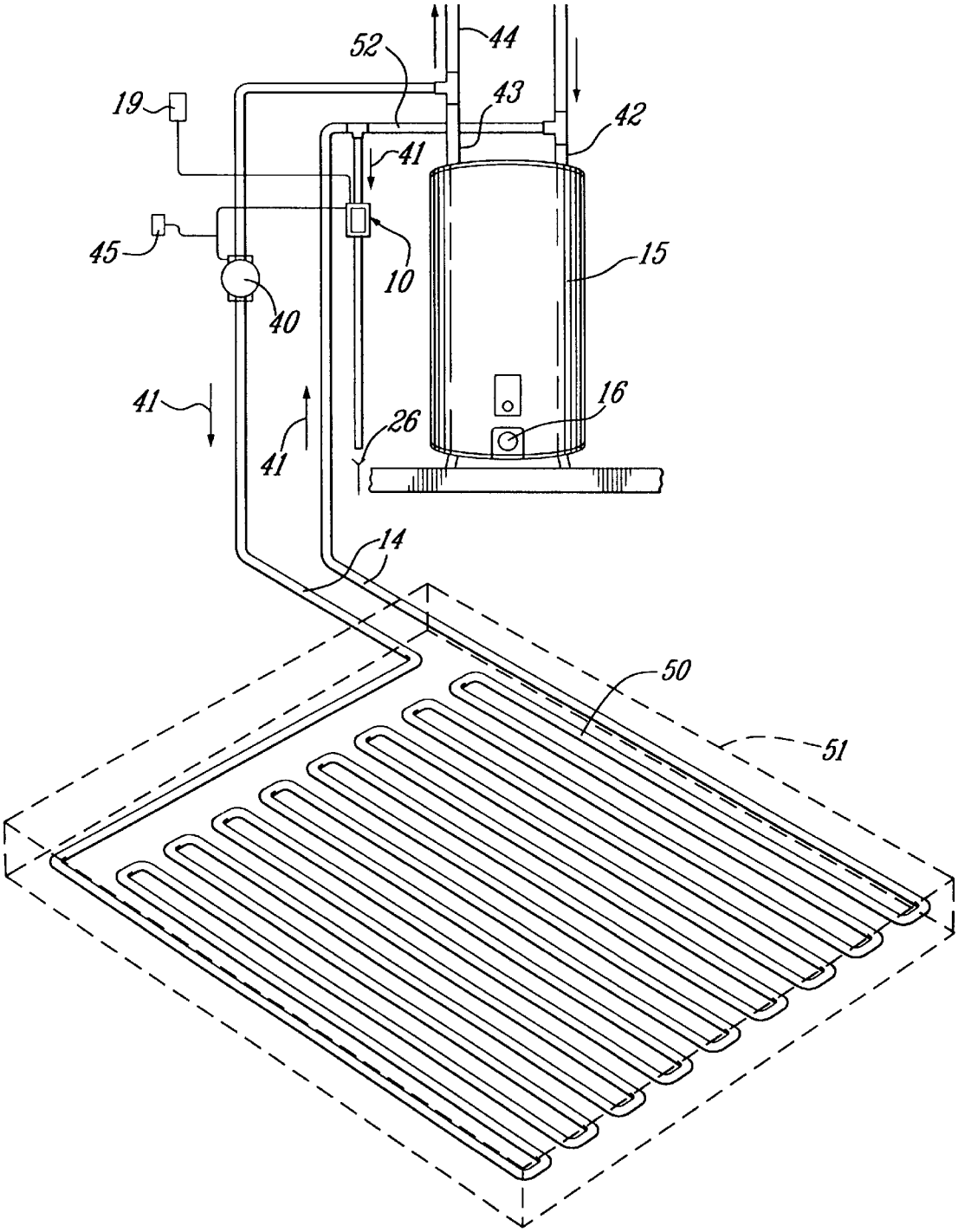
FIG. 4 is a further schematic diagram illustrating the automatic modulating regulator device of the present invention connected to a radiant heating system.

Referring now to FIG. 4, there is shown a radiant heating system utilizing the automatic modulating regulator device 10 of the present invention. The automatic modulating regulator device is connected in the same manner as described in FIG. 3 with the exception that the hot water circuit 14 feeds a serpentine array of tubes 50 which are cast in a concrete slab 51 during the construction of a building. The hot water circulated therethrough as indicated by arrows 41 and the automatic modulating regulator device 10 is connected in the return conduit 52. The operation is the same as previously described with reference to FIG. 3.

Figure 5:
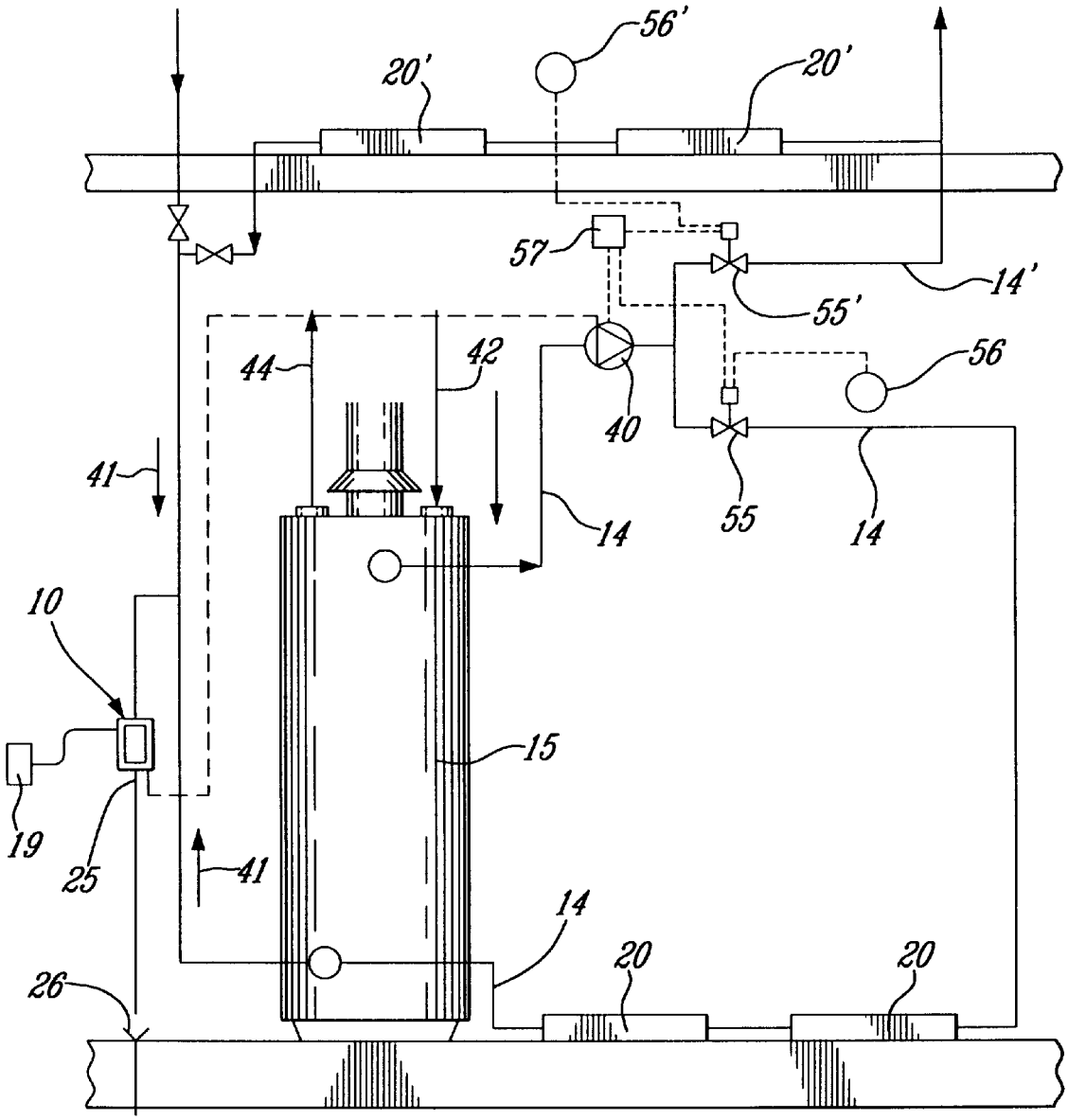
FIG. 5 is a further schematic diagram illustrating the automatic modulating regulator device integrated with a multi-level residential combo heating system using a gas-fired hot water heat source.

Referring now to FIG. 5, there is shown a multi-level residential building application and wherein the heat 15 source 15 has in its hot water circuit 14 a branch circuit 14' to feed hot water radiators 20' located in a different dwelling or apartment of a multi-level residential building. Each of the circuits 14 and 14' are provided with regulating valves 55 and 55' which are controlled by respective thermostats 56 and 56' to open or close their respective hot water circuit 14 or 14'. The valves 55 and 55' as well as the pump 40 are controlled by a transformer or relay 57 which, when subjected to an electrical power failure, places the valves 55 and 55' as well as the pump 40 in an open circuit condition. The transformer or relay device 57 is also connected to the solenoid actuator 17 of the normally open valve 11 in the automatic modulating regulator device.

It is within the ambit of the present invention to cover any obvious modifications of the preferred embodiment of the present invention as described herein. For example, the automatic modulating regulator device need not be coupled together and its main valve components may be connected to the return conduit at separate locations whereby to provide the same results. However, it is preferred for ease of installation that the normally open valve 11, the self-powered thermostatic valve 18 and the flow restrictor be connected together as a unit as shown in FIG. 2A. Those skilled in the art will appreciate that the conception, upon which this disclosure is based, may readily be utilized as a basis for the re-designing of other structures, methods and systems for carrying out the several purposes of the present invention. It is important, therefore, that the claims be regarded as including such equivalent constructions insofar as they do not depart from the spirit and scope of the present invention.

What is claimed is:

1. An automatic modulating regulator device for use with a non-electrical hot water heat source supplied by a pressurized water supply and having a hot water circuit to pump hot water to heat exchange elements, said regulator device comprising valve means adapted to be connected to a hot water return conduit of said hot water circuit, said valve means having an actuator means for placing said regulator device in a normally open condition in response to an electrical power failure, a self-powered thermostatic valve responsive to a temperature sensing means, for placing said regulator device in an open condition in response to heat demand by said temperature sensing means, and flow restrictor means for releasing controlled quantities of water from said return hot water conduit of said hot water circuit through said regulator device when both said valve means and thermostatic valve place said regulator device in an open condition, said valve means and said thermostatic valve being independently connected to a common valve disc disposed in obstruction to a flow-through conduit provided in a valve body of said regulator device.

2. An automatic modulating regulator device as claimed in claim 1 wherein said flow restrictor means is a flow regulating valve secured in said flow-through conduit downstream of said valve disc.

3. An automatic modulating regulator device as claimed in claim 1 wherein said thermostatic valve and valve means are concentrically mounted in said valve body transversely to said flow-through conduit, said common valve disc being actuated by spring biased pistons actuated respectively by said thermostatic valve and said valve means.

4. An automatic modulating regulator device as claimed in claim 1 wherein said flow restrictor means is a normally-open flow-restricting valve provided with settable control means to control the flow rate of said valve not to exceed the recovery rate of said heat source.

5. An automatic modulating regulator device as claimed in claim 4 wherein said temperature sensing means is an adjustable thermostat having a temperature sensor for sensing the ambient temperature of an area being heated by at least one of said heat exchange elements connected to said hot water circuit of said hot water heat source, said thermostat being set to a desirable temperature and sensing said thermostatic valve to modulate the hot water flow in said hot water circuit to substantially maintain said desirable temperature at said thermostat.

6. An automatic modulating regulator device as claimed in claim 5 wherein said actuator means is a solenoid which when electrically actuated places said valve means in a closed condition.

7. An automatic modulating regulator device as claimed in claim 6 wherein said actuator means is a motorized valve which when electrically activated places said valve means in a closed condition.

8. An automatic modulating regulator device as claimed in claim 1 wherein said valve means is a normally-open electrically operable valve, said valve having an inlet with a coupling to secure same to said hot water return conduit.

9. An automatic modulating regulator device as claimed in claim 5 wherein said normally-open flow-restricting valve has an outlet connected to a drain conduit to release water from said hot water return conduit into said drain conduit.

10. An automatic modulating regulator device as claimed in claim 1 wherein said heat source is a hot water tank of a combo system supplying hot water to said heat exchange elements for heating a building and to a hot water supply circuit to provide hot water for domestic use.

11. An automatic modulating regulator device as claimed in claim 10 wherein said heat exchange elements are hot water radiators.

12. An automatic modulating regulator device as claimed in claim 10 wherein said heat exchange elements are radiant heating elements secured in a floor or walls of a building.

13. An automatic modulating regulator device as claimed in claim 10 wherein said building is a multi-level residential building provided with a plurality of hot water supply conduits to supply hot water to a plurality of circuits each having a plurality of said heat exchange elements.

14. A method of supplying hot water to heat exchange elements connected to a hot water supply circuit of a non-electrical hot water heat source during electrical power failure, said heat source being supplied by a pressurized water supply, said method comprising the steps of:

i) providing an automatic regulator device in a hot water return conduit of said hot water supply circuit, said device having a flow-through conduit, an electrically operative valve associated with said conduit and being normally open in the absence of electrical power, a self-powered thermostatic valve also associated with said conduit and responsive to temperature change, and a flow restrictor connected to an output of said thermostatic valve and to a drain, ii) connecting a temperature sensor associated with said thermostatic valve to sense the ambient temperature of an area being heated by at least one of said heat exchange elements, iii) setting the flow rate of said thermostatic valve not to exceed the recovery rate of said water heat source, and iv) automatically placing said electrically operative valve in a normally open condition upon the loss of electrical power to release hot water from said hot water return conduit into said drain and in a controlled modulated manner whereby said hot water supply circuit is fed hot water under pressure by said pressurized water supply feeding said heat source and further wherein said hot water supply circuit is fed hot water from said heat source by an electrically operated pump, said step (iv) comprising feeding hot water from said heat source through said pump, into said hot water circuit, through said hot water return conduit and into said drain responsive to ambient temperature variation sensed by said thermostatic valve or the flow rate of said water heater source sensed by said flow restrictor.

15. A method as claimed in claim 14 wherein said pressurized water supply is a city water supply.

16. A method as claimed in claim 14 wherein there is further provided the step of automatically closing said normally-open electrically operative valve upon restoration of said electrical power failure.

17. An automatic modulating regulator device for use with a non-electrical hot water heat source supplied by a pressurized water supply and having a hot water circuit to pump hot water to heat exchange elements, said regulator device comprising valve means adapted to be connected to a hot water return conduit of said hot water circuit, said valve means having an actuator means for placing said regulator device in a normally open condition in response to an electrical power failure, a self-powered thermostatic valve responsive to a temperature sensing means, for placing said regulator device in an open condition in response to heat demand by said temperature sensing means, and flow restrictor means for releasing controlled quantities of water from said return hot water conduit of said hot water circuit through said regulator device when both said valve means and thermostatic valve place said regulator device in an open condition said flow restrictor means being a normally-open flow-restricting valve provided with settable control means to control the flow rate of said valve not to exceed the recovery rate of said heat source.

18. An automatic modulating regulator device as claimed in claim 17 wherein said temperature sensing means is an adjustable thermostat having a temperature sensor for sensing the ambient temperature of an area being heated by at least one of said heat exchange elements connected to said hot water circuit of said hot water heat source, said thermostat being set to a desirable temperature and sensing said thermostatic valve to modulate the hot water flow in said hot water circuit to substantially maintain said desirable temperature at said thermostat.

19. An automatic modulating regulator device as claimed in claim 18 wherein said actuator means is a solenoid which when electrically actuated places said valve means in a closed condition.

20. An automatic modulating regulator device as claimed in claim 19 wherein said actuator means is a motorized valve which when electrically activated places said valve means in a closed condition.

* * * * *